US009275500B2

(12) United States Patent
Nam et al.

(10) Patent No.: US 9,275,500 B2
(45) Date of Patent: Mar. 1, 2016

(54) SYSTEM AND METHOD FOR DETECTING THE CONDITION OF A COOLANT IN A VEHICLE

(71) Applicant: Hyundai Motor Company, Seoul (KR)

(72) Inventors: Gi Young Nam, Yongin (KR); Minkyu Lee, Incheon (KR)

(73) Assignee: Hyundai Motor Company, Seoul (KR)

( * ) Notice: Subject to any disclaimer, the term of this patent is extended or adjusted under 35 U.S.C. 154(b) by 100 days.

(21) Appl. No.: 14/068,365

(22) Filed: Oct. 31, 2013

(65) Prior Publication Data

US 2014/0303831 A1 Oct. 9, 2014

(51) Int. Cl.

| | |
|---|---|
| ***G07C 5/00*** | (2006.01) |
| ***F28F 27/00*** | (2006.01) |
| ***G07C 5/08*** | (2006.01) |

(52) U.S. Cl.

CPC ..... *G07C 5/006* (2013.01); *F28F 27/00* (2013.01); *G07C 5/0808* (2013.01); *F01P 2025/80* (2013.01)

(58) Field of Classification Search

CPC ..... G07C 5/006; G07C 5/0808; F28F 27/00; H01M 8/04; B60L 11/18; F01P 2003/003; F01P 2023/00–2023/08; F01P 2025/08; F01P 2025/30; F01P 2025/32; F01P 2025/80; F01P 2031/00; F01P 2031/20; F01P 2031/22; F01P 2050/00–2050/30

USPC ..... 701/29.4

See application file for complete search history.

(56) References Cited

U.S. PATENT DOCUMENTS

| | | | | |
|---|---|---|---|---|
| 4,338,959 | A * | 7/1982 | Krueger et al. | 137/93 |
| 4,662,232 | A * | 5/1987 | Gonsalves et al. | 73/866.5 |
| 4,666,582 | A * | 5/1987 | Blankenship et al. | 204/404 |
| 4,827,242 | A * | 5/1989 | Blankenship et al. | 340/450 |
| 5,521,581 | A * | 5/1996 | Proulx | 340/449 |
| 8,129,061 | B2 * | 3/2012 | Fujita | 429/437 |
| 2004/0224201 | A1 * | 11/2004 | St-Pierre et al. | 429/26 |
| 2014/0303831 | A1 * | 10/2014 | Nam et al. | 701/29.4 |

FOREIGN PATENT DOCUMENTS

| | | | |
|---|---|---|---|
| JP | 2002-295848 | A | 10/2002 |
| JP | 2003036869 | A | 2/2003 |
| KR | 20-1998-0038629 | U | 9/1998 |
| KR | 10-1102320 | | 3/2011 |
| KR | 10-2012-0032360 | A | 4/2012 |

OTHER PUBLICATIONS

Nam et al., KR1020120032360, Apr. 5, 2012 (Machine Translation).*

* cited by examiner

*Primary Examiner* — Fadey Jabr
*Assistant Examiner* — Courtney Heinle
(74) *Attorney, Agent, or Firm* — Mintz Levin Cohn Ferris Glovsky and Popeo, P.C.; Peter F. Corless

(57) ABSTRACT

A cooling system according to an exemplary embodiment may include a heat generation device that is cooled by a coolant solution that exchanges heat with the heat generation device to maintain the heat generation device at a required temperature. More specifically, the cooling system includes a temperature sensor that detects a temperature of the coolant solution, a conductivity sensor that detects the conductivity of the coolant solution, and a controller that uses coolant solution temperature and coolant solution conductivity that are detected through the temperature sensor and the conductivity sensor to determine a condition of the coolant solution.

7 Claims, 4 Drawing Sheets

FIG. 2

$$\text{Compensation coefficient} = \frac{C1 - C2}{C2(T1-25) - C1(T2-25)}$$

SYSTEM AND METHOD FOR DETECTING THE CONDITION OF A COOLANT IN A VEHICLE

CROSS-REFERENCE TO RELATED APPLICATION

This application claims priority to and the benefit of Korean Patent Application No. 10-2013-0036753 filed in the Korean Intellectual Property Office on Apr. 4, 2013, the entire contents of which are incorporated herein by reference.

BACKGROUND OF THE INVENTION (a) Field of the Invention

The present invention relates to a system and method of monitoring the condition of coolant (e.g., anti-freeze) solution and informs the driver when it is necessary to replace or add coolant solution accordingly.

(b) Description of the Related Art

As a vehicle is being operated, coolant solution is continually flushed throughout the system. As a result, this solution continuously decreases over time. Accordingly, users typically add coolant solution (e.g., anti-freeze) to the vehicle at their discretion.

Generally, when coolant/anti-freeze solution is replenished, it may be difficult to accurately detect the conductivity of the coolant solution, especially when distilled-water is added. This makes it is hard to determine the condition of coolant solution via conductivity. Alternatively, in some cases, when coolant solution is added incorrectly. In doing so, the freezing point of coolant solution is increased and thus, the coolant solution then may become frozen in the winter. As a result, the cooling system of a fuel cell or an engine cannot be normally operated when this occurs.

Generally, conductivity of liquid is changed depending on its temperature and the kind of substance the liquid is made up of. Thus, determining the conductivity of an coolant solution can be difficult and thus there is a need for a process which is able to accurately detect the temperature and conductivity of the coolant solution (e.g., anti-freeze) in a vehicle The above information disclosed in this Background section is only for enhancement of understanding of the background of the invention and therefore it may contain information that does not form the prior art that is already known in this country to a person of ordinary skill in the art.

SUMMARY

The present invention has been made in an effort to provide a cooling system that is configured to monitor and determine the condition of coolant solution by utilizing a detected temperature and conductivity of the coolant solution that notify a driver or an operator to replenish or check the vehicle's coolant levels.

A cooling system according to an exemplary embodiment of the present invention may include a heat generation device that generates heat, a coolant solution (e.g., anti-freeze) that exchanges heat with the heat generation device to cool the heat generation device, a temperature sensor that detects a temperature of the coolant solution, a conductivity sensor that detects the conductivity of the coolant solution, and a controller that executes processes via a processor and memory to determine the condition of the coolant solution by using the detected coolant solution temperature and coolant solution conductivity.

Furthermore, in some exemplary embodiments of the present invention, the above controller may also utilize the coolant solution temperature and coolant solution conductivity to calculate a compensation coefficient. More specifically, the controller may determine that the coolant solution is normal, when the compensation coefficient is in a predetermined range, and the controller may determine that the coolant solution is abnormal, when the compensation coefficient is greater than or less than a predetermined range.

The controller in some exemplary embodiments of the present invention may detect a first conductivity C1 of the coolant solution and a first temperature T1 of the coolant solution at a predetermined first point, and the controller may detect a second conductivity C2 of the coolant solution and a second temperature T2 of the coolant solution at a predetermined second point. As such, the compensation coefficient (C_coef) may be calculated through a formula: $C_coef=(C1-C2)/[C2*(T1-TR)-C1*(T2-T_R)]$, where a reference temperature ($T_R$) may be 25° C., for example. Furthermore, when it is determined that the compensation coefficient is out of a predetermined range, the controller may be configured to that the coolant solution is in an abnormal condition and an alarm signal may be generated to light an emergency lamp of a cluster or provide an alert sound or both.

Additionally, in some exemplary embodiments, the heat generation portion may include a fuel cell, an engine, or any other heat source which requires a coolant in a vehicle to maintain a certain temperature. As described above, a cooling system according to an exemplary embodiment of the present invention calculates a compensation coefficient through temperature and conductivity of coolant solution at predetermined intervals and uses a compensation coefficient to be able to determine whether the condition of the coolant solution is normal or not. Also, when the compensation coefficient exceeds a predetermined range, a warning lamp may be lit on a cluster or a sound may be emitted to be able to quickly inform a user of the condition of the coolant in the vehicle. Finally, the coolant solution prevented from becoming frozen by continually monitoring the coolant's condition.

BRIEF DESCRIPTION OF THE DRAWINGS

FIG. 2 is a formula showing a method for calculating a compensation coefficient according to an exemplary embodiment of the present invention.

DETAILED DESCRIPTION OF THE EMBODIMENTS

An exemplary embodiment of the present invention will hereinafter be described in detail with reference to the accompanying drawings.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles, fuel cell vehicles, and other alternative fuel vehicles (e.g. fuels derived from resources other than petroleum).

Additionally, it is understood that the below methods are executed by at least one controller. The term controller refers to a hardware device that includes a memory and a processor configured to execute one or more processes that should be interpreted as the controller's algorithmic structure. The memory is configured to store algorithmic steps and the processor is specifically configured to execute said algorithmic steps to perform one or more processes which are described further below.

Furthermore, the control logic (i.e., the algorithmic steps) of the present invention may be embodied as non-transitory computer readable media on a computer readable medium containing executable program instructions executed by the processor. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

Figure 1:
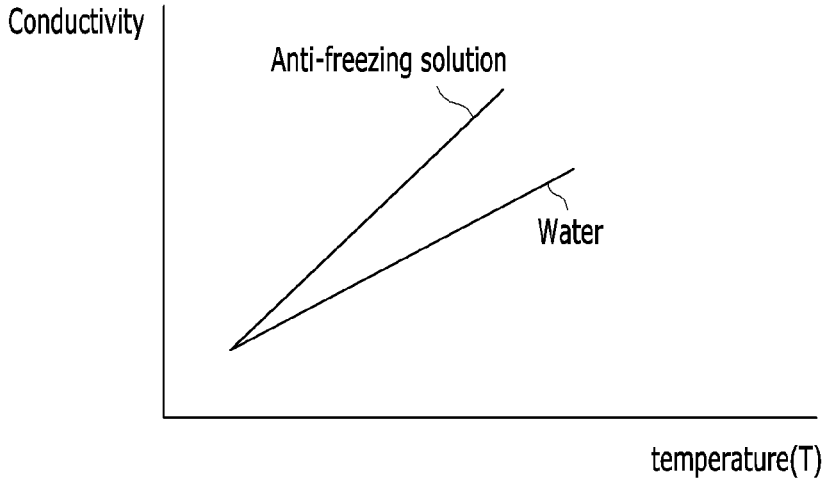
FIG. 1 is a graph showing conductivity changes of coolant solution and water based on temperature according to an exemplary embodiment of the present invention.

FIG. 1 is a graph showing conductivity changes of coolant solution and water based on temperature according to an exemplary embodiment of the present invention. Referring to FIG. 1, a horizontal axis denotes temperature of coolant solution or water as coolant and a vertical axis denotes conductivity thereof.

As shown in the drawings, the conductivity of the coolant solution or water is changed depending on the temperature thereof with a predetermined slope. As can be seen from FIG. 1, the slope of the line denoting the conductivity of the coolant solution depending on the temperature is larger than the slope of the line denoting the conductivity of water depending on the temperature.

FIG. 2 is a formula showing a method for calculating a compensation coefficient according to an exemplary embodiment of the present invention. Referring to FIG. 2, a compensation coefficient can be calculated by a predetermined formula and the compensation coefficient in an exemplary embodiment of the present invention is calculated through a formula that is shown in the FIG. 2. However, this formula is for exemplary purposes only and thus, should not be interpreted as the only formula that can be used to calculate the above compensation coefficient.

In the example embodiment of the present invention using the above formula, C1 and T1 denote a first conductivity and a first temperature of coolant solution at a predetermined first timing, and C2, T2 denote a second conductivity and a second temperature of coolant solution at a predetermined second timing. As such, the compensation coefficient (C_coef) may be calculated through a formula: $C_coef=(C1-C2)/[C1*(T1-TR)-C1*(T2-T_R)]$, where a reference temperature ($T_R$) may be 25° C., for example.

Figure 3:
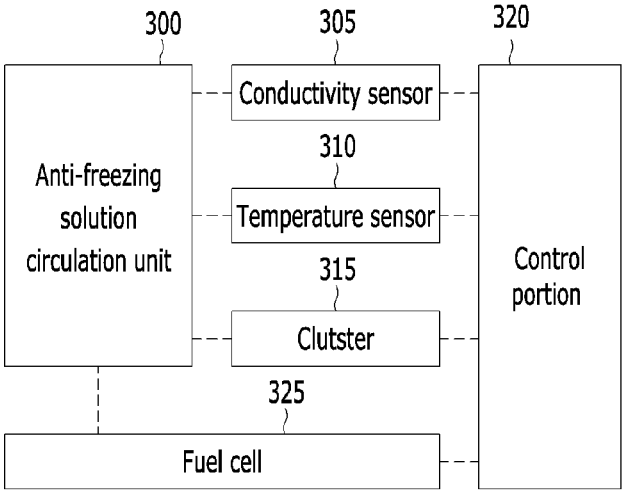
FIG. 3 is a schematic diagram of a cooling system according to an exemplary embodiment of the present invention.

FIG. 3 is a schematic diagram of a fuel cell cooling system using coolant solution according to an exemplary embodiment of the present invention. Referring to FIG. 3, a fuel cell cooling system includes an coolant solution circulation unit 300, a conductivity sensor 305, a temperature sensor 310, a cluster 315, a heat generation device 325 (e.g., a fuel cell, internal combustion engine, etc.), and a controller 320.

The coolant solution circulation unit 300 includes coolant solution as coolant and the coolant solution circulates the coolant through the heat generation device 325 to prevent overheating of the device 325. The conductivity sensor 305 detects the conductivity of the coolant solution circulating through the fuel cell 325 and the temperature sensor 310 detects the temperature of the coolant solution accordingly.

In order to accurately monitor the condition of the coolant in the coolant system, controller 320 in the above coolant system uses the conductivity of the coolant solution that is detected by the conductivity sensor 305 and the temperature of the coolant solution that is detected by the temperature sensor 310 to calculate a compensation coefficient. In particular, the controller, for example, may be configured to execute the formula that is shown in FIG. 2 to calculate the compensation coefficient (C_coef). As stated above, however, the illustrative embodiment is not limited to this formulation and thus the compensation value can be calculated by an alternative r formula or algorithm.

Regardless, when the compensation coefficient (C_coef) that is calculated by the controller 320 is within a predetermined range, the controller 320 determines that the coolant solution is in a normal condition. On the contrary, when the compensation coefficient (C_coef) that is calculated by the controller 320 is out of (greater than or less than) the predetermined range, the controller 320 determines that the coolant solution is in an abnormal condition and outputs an abnormal signal for the coolant solution. In some embodiments a warning lamp may be lit by the abnormal signal for the coolant solution on the cluster 315, or a sound may be emitted to the driver.

It should be noted that the above predetermined range is dependent upon the type of coolant that is being used and thus, specific values of this range are omitted for brevity. This predetermined range can be set by the manufacture based upon the specific characteristics of the coolant which is used in the vehicle and thus, the range in the exemplary embodiments should not be limited to any particular value.

In an exemplary embodiment of the present invention, it has been described that the coolant solution circulates the fuel cell to cool the stack of the fuel cell, but heat generation portion such as a fuel cell can include an internal combustion engine.

Figure 4:
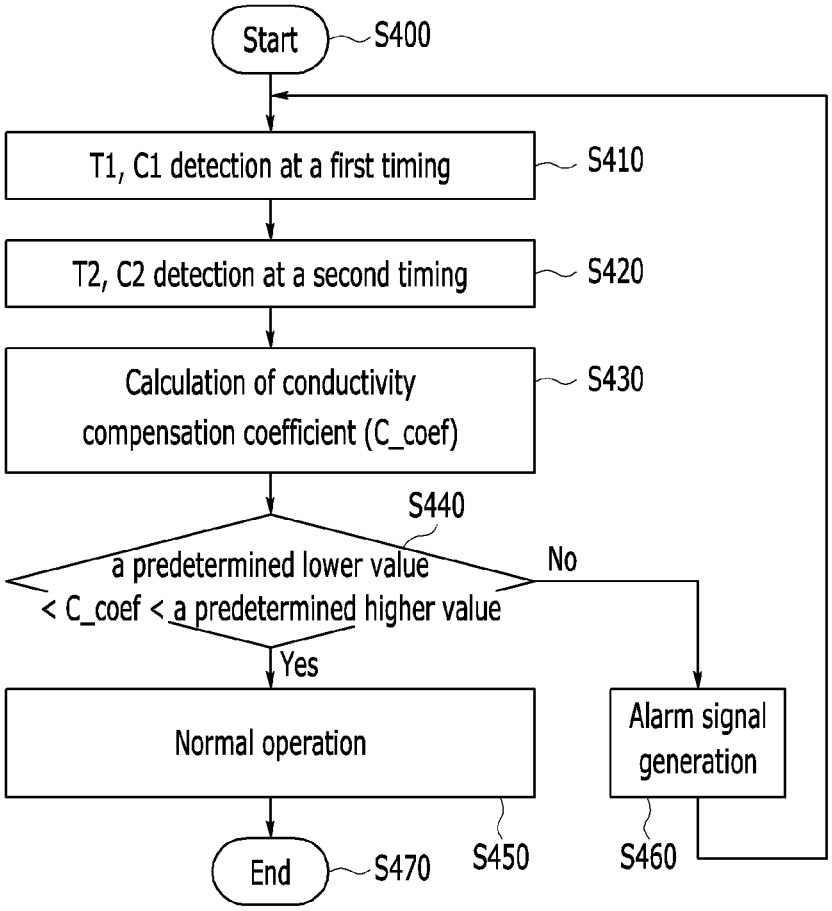
FIG. 4 is a flowchart showing a control method of a cooling system according to an exemplary embodiment of the present invention.

FIG. 4 is a flowchart showing a control method (i.e., algorithm) of a cooling system according to an exemplary embodiment of the present invention. Referring to FIG. 4, a control is started in a S400 and a first temperature T1 and a first conductivity C1 of coolant solution are detected at a predetermined first timing (i.e., at a first interval) in a S410. A second temperature T2 and a second conductivity C2 of coolant solution are detected at a predetermined second timing (i.e., at a second interval) in a S420. And, the first temperature T1, the second temperature T2, the first conductivity C1, and the second conductivity C2 are used to calculate a compensation coefficient in a S430. It is then determined whether the compensation coefficient (C_coef) is greater than a predetermined lower value and less than a predetermined higher value in a S440. As stated above, these values are set by the manufacture.

When the compensation coefficient (C_coef) is between the predetermined lower value and the predetermined higher value, the coolant solution circulation unit is determined be operating normally in a S450. And, when the compensation coefficient (C_coef) is less than the predetermined lower value or greater than the predetermined higher value, a S460 is performed because the controller determines that the circulation unit is operating abnormally.

As such, an alarm signal is generated in a S460 when such an abnormal condition is detected. In this case, the controller 320 may light a warning lamp that signifies an abnormal condition of the coolant solution on the cluster 315. It is described that an alarm signal is generated and a warning lamp is lighted on the cluster in an exemplary embodiment of the present invention, but a separate alarm sound can be generated instead of the warning lamp without departing form the overall concept.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

| <Description of symbols> | |
|---|---|
| 300: coolant solution circulation unit | 305: conductivity sensor |
| 310: temperature sensor | 315: cluster |
| 320: controller | 325: heat generation device |

What is claimed is:

1. A cooling system using coolant solution, comprising:

a heat generation device generating heat;

coolant solution that exchanges heat with the heat generation device to cool the heat generation device;

a temperature sensor that detects a temperature of the coolant solution;

a conductivity sensor that detects a conductivity of the coolant solution; and a controller that determines a condition of the coolant solution based upon the detected coolant solution temperature and the detected coolant solution conductivity that are detected through the temperature sensor and the conductivity sensor, wherein the controller calculates a compensation coefficient based upon the detected coolant solution temperature and the detected coolant solution conductivity, the controller detects a first conductivity C1 of the coolant solution and a first temperature T1 of the coolant solution at a predetermined first point in time, and the controller detects a second conductivity C2 of the coolant solution and a second temperature T2 of the coolant solution at a predetermined second point in time, the compensation coefficient (C_coef) is calculated through a formula:

$$C_coef=(C1-C2)/[C2*(T1-25)-C1*(T2-25)],$$

and when the controller determines that the compensation coefficient exceeds a predetermined range, the controller determines that the coolant solution is in an abnormal condition and generates an alarm signal to light an emergency lamp of a cluster or sound an alarm.

2. The cooling system using coolant solution of claim 1, wherein the controller determines that the coolant solution is normal, when the compensation coefficient is within the predetermined range, and the controller determines that the coolant solution is abnormal, when the compensation coefficient exceeds the predetermined range.

3. The cooling system using coolant solution of claim 1, wherein the heat generation device includes a fuel cell.

4. The cooling system using coolant solution of claim 1, wherein the heat generation device includes an internal combustion engine.

5. A method comprising:

detecting, by a temperature sensor, a temperature of a coolant solution in a coolant system of a vehicle;

detecting, by a conductivity sensor, a conductivity of the coolant solution;

determining, by a controller, a condition of the coolant solution in the coolant system of the vehicle based upon the detected coolant solution temperature and the detected coolant solution conductivity;

calculating a compensation coefficient based upon the detected coolant solution temperature and the detected coolant solution conductivity;

detecting a first conductivity C1 of the coolant solution and a first temperature T1 of the coolant solution at a predetermined first point in time; and detecting a second conductivity C2 of the coolant solution and a second temperature T2 of the coolant solution at a predetermined second point in time, wherein the compensation coefficient (C_coef) is calculated through a formula:

$$C_coef=(C1-C2)/[C2*(T1-25)-C1*(T2-25)],\text{ and}$$

when the controller determines that the compensation coefficient exceeds a predetermined range, the controller determines that the coolant solution is in an abnormal condition and generates an alarm signal to light an emergency lamp of a cluster or sound an alarm.

6. The method of claim 5, comprising:

determining that the coolant solution is normal, when the compensation coefficient is within the predetermined range; and determining that the coolant solution is abnormal, when the compensation coefficient exceeds the predetermined range.

7. A non-transitory computer readable medium containing program instructions executed by a processor on a controller, the computer readable medium comprising:

program instructions that detect a temperature of a coolant solution in a coolant system of a vehicle;

program instructions that detect a conductivity of the coolant solution; program instructions that determine a condition of the coolant solution in the coolant system of the vehicle based upon the detected coolant solution temperature and the detected coolant solution conductivity;

program instructions that calculate a compensation coefficient based upon the detected coolant solution temperature and the detected coolant solution conductivity;

program instructions that detect a first conductivity C1 of the coolant solution and a first temperature T1 of the coolant solution at a predetermined first point in time; and program instructions that detect a second conductivity C2 of the coolant solution and a second temperature T2 of the coolant solution at a predetermined second point in time, wherein the compensation coefficient (C_coef) is calculated through a formula:

$$C_coef=(C1-C2)/[C2*(T1-25)-C1*(T2-25)],\text{ and}$$

when the controller determines that the compensation coefficient exceeds a predetermined range, the controller determines that the coolant solution is in an abnormal condition and generates an alarm signal to light an emergency lamp of a cluster or sound an alarm.

* * * * *